United States Patent [19]

Schoenmakers

[11] 4,052,633

[45] Oct. 4, 1977

[54] RESTORABLE COLD CATHODE IN A GAS DISCHARGE ELECTRON GUN

[75] Inventor: Theodorus Maria Berendina Schoenmakers, Eindhoven, Netherlands

[73] Assignee: U.S. Philips Corporation, New York, N.Y.

[21] Appl. No.: 575,614

[22] Filed: May 8, 1975

[30] Foreign Application Priority Data

May 30, 1974 Netherlands ..... 7407254

[51] Int. Cl.[2] ..... H01J 3/02; H01J 7/24; H01J 17/06

[52] U.S. Cl. ..... 313/146; 219/121 EB; 313/217; 313/237; 315/111.8

[58] Field of Search ..... 315/111.8; 313/231, 313/362, 150, 231.4, 231.5, 359, 237, 146, 217; 219/121 EB, 121 P

[56] References Cited

U.S. PATENT DOCUMENTS

| | | | |
|---|---|---|---|
| 2,892,118 | 6/1959 | Gretener | 313/146 X |
| 3,393,339 | 7/1968 | Hill et al. | 313/359 X |
| 3,418,510 | 12/1968 | Melhart | 313/146 |
| 3,486,064 | 12/1969 | Stauffer | 313/231 |
| 3,678,334 | 7/1972 | Dugdale et al. | 315/111.8 |
| 3,891,824 | 6/1975 | Essers | 219/121 P |

*Primary Examiner*—Palmer C. Demeo
*Attorney, Agent, or Firm*—Frank R. Trifari

[57] ABSTRACT

Restorable cold cathode in a gas discharge electron ion gun in which the eroded material in the active surface of the cathode is restored by supplying new material in the form of a wire which is moved through a hole in the cathode body by means of a screw spindle.

7 Claims, 6 Drawing Figures

RESTORABLE COLD CATHODE IN A GAS DISCHARGE ELECTRON GUN

Figure 1:
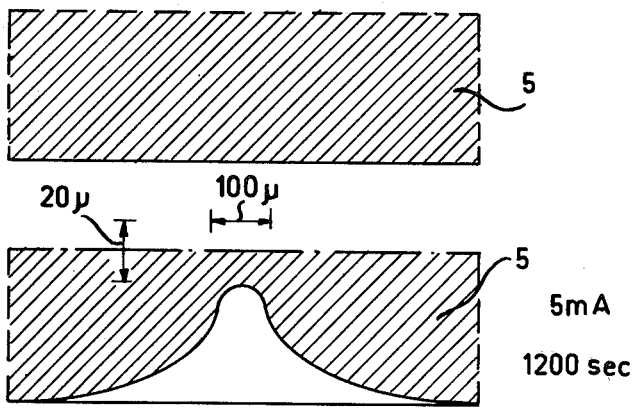

The present invention relates to a gas discharge electron gun for generating an electron beam by means of a glow discharge and consisting at least of an envelope, means to maintain a gaseous ionisable medium inside said envelope, which envelope comprises at least an anode and a cathode between which the said glow discharge takes place, from which cathode electrons are released by secondary emission in such a quantity that the said electron beam consists mainly of said electrons and which cathode has such a construction that the results of the erosion occurring at the cathode surface are considerably reduced.

Such a gas discharge electron gun is known from the British patent specification No. 1,145,013. Positive ions from the glow discharge collide against the cathode and release electrons there. Said electrons are accelerated away from the cathode. The electric field near the cathode has such a shape that the ions and electrons experience a strong component of said field parallel to the cathode surface. As a result of this the ion current is directed more or less towards a small part of the surface of the cathode and the electrons leave the cathode in the form of a narrow beam. According to the British Patent Specification a cavity in the centre of the cathode influences the shape of the electric field and hence the shape of the electron beam. Said British Patent Specification describes a rotating cathode which spreads the erosion during operation over a large area and thus increases the life of the cathode. When, however, a cavity has formed in the cathode, the latter should be replaced because in that case the shape of the electric field had become different as a result of said cavity. A large divergence of the generated electron beam occurs so that more electrons are lost and collide, for example, against the anode and recombine, which involves a decrease of the efficiency of the gas discharge electron gun and a reduction of the energy density in the electron beam. Moreover, the emission properties of the cathode becomes more unfavourable in that the ions are no longer incident at right angles to the cathode and hence release fewer electrons.

It is known that the erosion of the cathode occurs more slowly by using as a gaseous ionisable medium light gases such as hydrogen and helium instead of air. In the case of hydrogen, however, this is dangerous in the case of a disturbance. Moreover, said gases are expensive as compared with, for example, air.

It is the object of the invention to provide a cathode which does substantially not show said erosion phenomena, independently of the chosen gaseous ionizable medium.

According to the invention, a gas discharge electron gun of the kind mentioned in the first paragraph is characterized in that the said results of the erosion are decreased by restoring the material in the active part of the cathode surface at least partly during operation of the gas discharge electron gun. As a result of this, the excavation as a result of erosion and the consequent detrimental effects will substantially not occur. The great advantage of this is that the production process in which the electron beam of the gas discharge electron gun is used need not be interrupted to replace the cathode. Another advantage is that the external gas discharge electron gun geometry having a cathode according to the invention can be made to be much smaller than, for example, in a rotating cathode. The restoring in a cylindrical symmetrical cathode may be carried out by supplying a wire via a preferably axial aperture in the cathode in the direction of and to the active cathode surface. This can be done, for example, by means of a screw spindle. The material of which the said wire consists need not be the same as the material of the cathode but may be, for example, material having a larger emission coefficient. The wire may be composed of several cylinders slid around a core, whether or not made of the same material, which are each supplied to the cathode surface at their own speed. The wire may also be provided so as to be electrically insulated relative to the remainder of the cathode, by which small potential differences between the wire and the remainder are possible and hence an influencing of the electric field.

It is recommendable to control the speed at which the material is supplied to the active cathode surface by continuously measuring the extent of divergence of the electron beam by means of a probe and reacting to variations therein.

Figure 2:
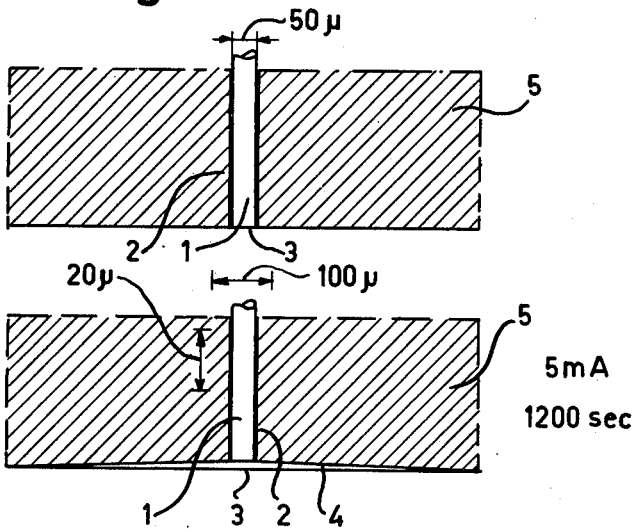
Figure 3:
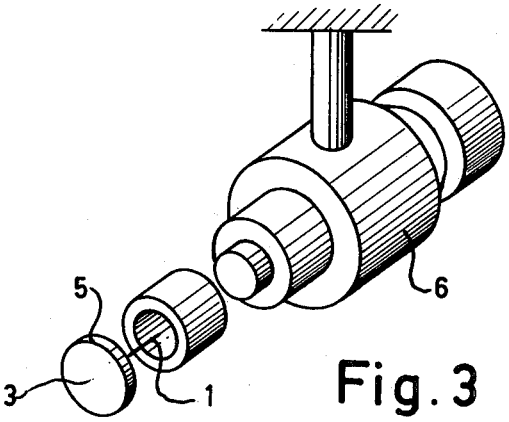
Figure 6:
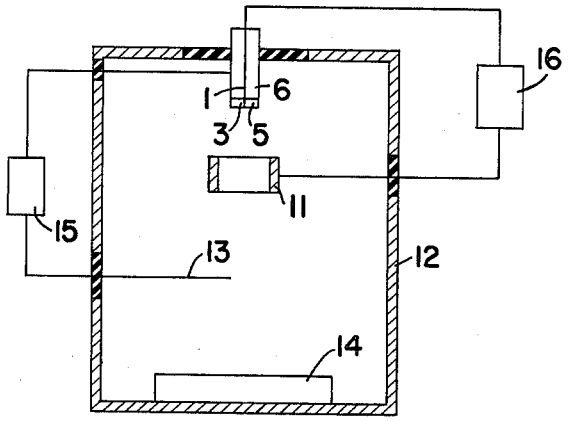
Figure 4:
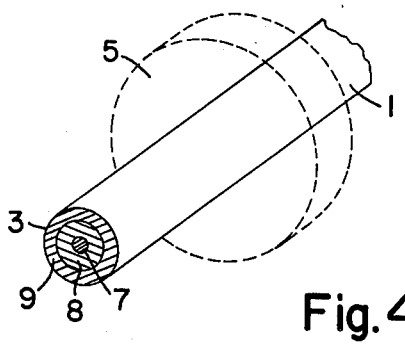
Figure 5:
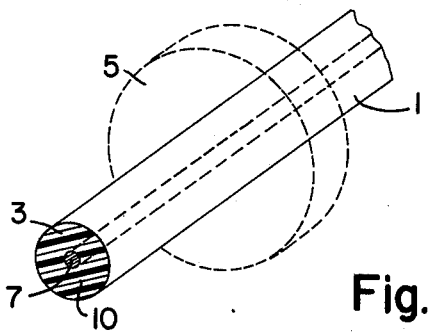

The invention will now be described in greater detail with reference to a drawing, of which FIG.1 illustrates the erosion, FIG. 2 shows the reduction of the ersoion by using the invention, FIG. 3 shows the construction with a screw spindle, FIG. 4 illustrates a multicore feeding wire, FIG. 5 shows an insulated feeding wire, and FIG. 6 shows schematically a gas discharge electron gun embodying this invention.

The upper figure of FIG. 1 shows the cathode surface before use of the cathode. After use at 5 mA for 20 minutes, it is seen that an approximately 40 μm deep and 700 μm wide pit has formed (lower figure of FIG. 1). Said pit will have the already mentioned detrimental results for the operation of the gas discharge electron gun.

FIG. 2 shows a situation according to the invention. A wire 1 is conveyed towards the cathode surface 3 via an aperture in the cathode 2. In a cathode in which electrons are released from a line instead of from a point, a sheet is conveyed to the cathode surface via an aperture. When the wire or sheet is transported at the correct speed, which depends on the material and the adjustment of the parameters of the gas discharge electron gun, the influence of the erosion 4 is substantially negligible as is shown in the lower figure of FIG. 2. Instead of one wire, several wires of different materials may also be supplied to the cathode. Due to the different emission coefficients of said materials, an electron beam having a given density structure can be obtained. This is necessary, for example, in X-ray or electron beam diffraction. The wire 1 may also consist of several cylinders 7 to 9 slid concentrically one into the other, as shown in FIG. 4 and each consisting of the same material or of different materials; FIG. 5 illustrates an embodiment where the wire 7 consists of an electrically conductive core 7 surrounded by a cylinder 10 of an insulating material.

FIG. 3 shows a construction for the supply of the said wire 1 by means of a screw spindle 6 to the cathode 5. Said screw spindle may be driven, for example, by a clock or a motor the speed of which is controlled in accordance with, for example, the divergence of the electron beam. The driving may be continuous or in sufficiently small steps.

The invention is by no means restricted to wires of a solid metal. A liquid metal having the correct vapour pressure may also be used.

A continuous operation of the gas discharge electron gun shown by way of an example in FIG. 6, is possible by using the invention and this gives no rise to interruptions of the production process on a workpiece 14. The material released by the erosion sputters partly on the electrodes 11 and 13 and the inner wall of the envelope 12 and is partly exhausted.

The voltage from the source 16 connected between the anode 11, and the cathode 5 may also be reversed and adapted so that an ion beam is formed instead of an electron beam.

What is claimed is:

1. A gas discharge electron gun for generating an electron beam by means of a glow discharge comprising an envelope, means to maintain a gaseous ionizable medium inside said envelope, at least an anode and a cathode between which the said glow discharge takes place, from which cathode electrons are released by secondary emission in such a quantity that the said electron beam consists mainly of said electrons and which cathode has a shape that reduces the erosion occurring at the cathode surface, and wire means for restoring the eroded material in the active part of the cathode surface at least partly during operation of the gas discharge electron gun, said wire means comprising a plurality of slideable concentric cylinders extending through an aperture in the active surface of the cathode.

2. A gas discharge electron gun as claimed in claim 1, wherein the wire means is moved by means of a screw spindle.

3. A gas discharge electron gun as claimed in claim 1, wherein the wire means consists of a material differing from the material of which the cathode consists.

4. A gas discharge electron gun as claimed in claim 1, wherein said wire means is electrically insulated with respect to the cathode.

5. A gas discharge electron gun as claimed in claim 1, wherein the speed at which the material is supplied to the active cathode surface is controlled in accordance with the divergence of the electron beam, said divergence being measured with a probe.

6. A gas discharge electron gun as claimed in claim 2, wherein said spindle is driven continuously.

7. A gas discharge electron gun as claimed in claim 1, wherein each cylinder is supplied to the cathode surface at its own speed.

* * * * *